United States Patent [19]

Grandel et al.

[11] 4,146,661

[45] Mar. 27, 1979

[54] FILM SPLICE

[75] Inventors: Johannes Grandel, Frankfurt am Main; Karlheinz Streuernagel, Morfeldon, both of Fed. Rep. of Germany

[73] Assignee: Braun Aktiengesellschaft, Frankfurt am Main, Fed. Rep. of Germany

[21] Appl. No.: 739,705

[22] Filed: Nov. 8, 1976

[30] Foreign Application Priority Data

Nov. 7, 1975 [DE] Fed. Rep. of Germany ..... 2550052

[51] Int. Cl.[2] ..... B65H 21/00; G03D 15/04

[52] U.S. Cl. ..... 428/42; 156/157; 156/304; 156/505; 156/506; 352/239; 428/40; 428/58; 428/61; 428/124; 428/137; 428/189; 428/191; 428/212; 428/343; 428/352; 428/354

[58] Field of Search ..... 428/40, 41, 42, 57, 428/58, 61, 343, 352, 354, 212, 189, 191, 124, 137; 156/505, 506, 157, 159, 304; 352/229, 233, 235, 237, 239, 244

[56] References Cited

U.S. PATENT DOCUMENTS

| | | | |
|---|---|---|---|
| 2,969,106 | 1/1961 | Reibel et al. | 428/41 |
| 3,136,678 | 6/1964 | Herzig | 156/157 |
| 3,424,644 | 1/1969 | Nakagome | 428/61 |
| 3,434,898 | 3/1969 | Freedman | 156/157 |
| 3,475,263 | 10/1969 | Kapilon et al. | 156/505 |
| 3,733,240 | 5/1973 | Hanke | 428/41 |
| 3,764,440 | 10/1973 | Schroter et al. | 156/505 |
| 3,904,472 | 9/1975 | Glaus | 156/505 |
| 3,914,491 | 10/1975 | Takahashi | 156/505 |
| 4,004,362 | 1/1977 | Barbieri et al. | 428/40 |
| 4,010,062 | 3/1977 | Müller et al. | 156/506 |
| 4,041,201 | 8/1977 | Wurker | 428/124 |

*Primary Examiner*—Stanley S. Silverman
*Attorney, Agent, or Firm*—Michael J. Striker

[57] ABSTRACT

A film splice for joining butted-together film ends, comprising carrier foil bands; a pair of discrete adhesive film-splicing tabs provided on the carrier foil means; and a positioning strip engaging the tabs and operative for positioning the same in predetermined orientation relative to one another when the tabs are respectively adhesively applied to one and to another side of film strips to join together the respective butted-together ends thereof.

13 Claims, 9 Drawing Figures

FIG.1
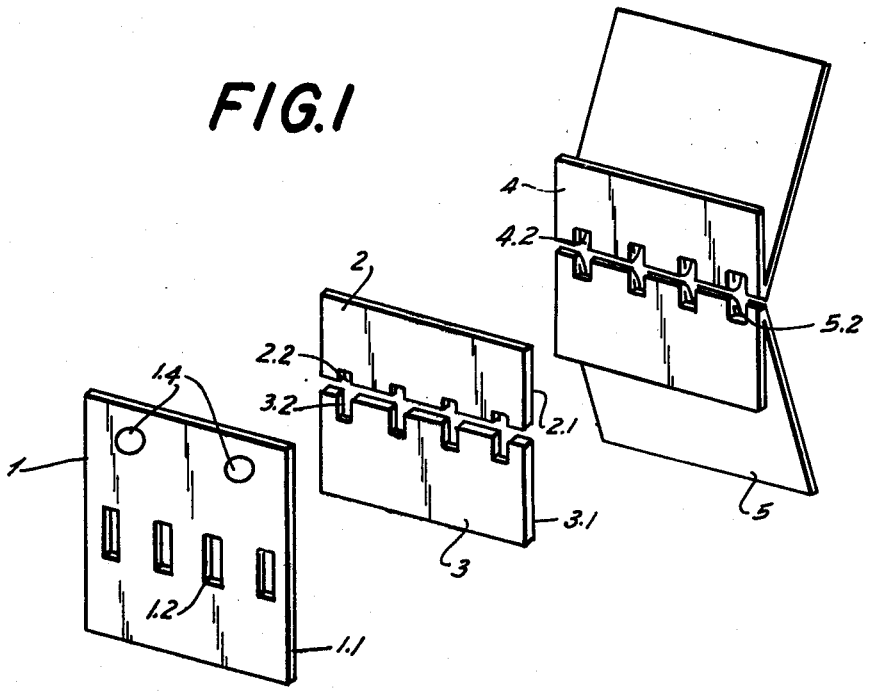
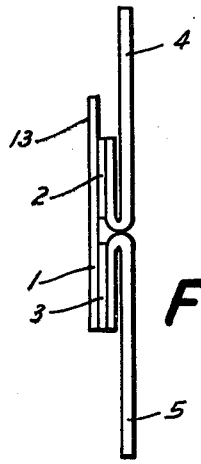
FIG. 2

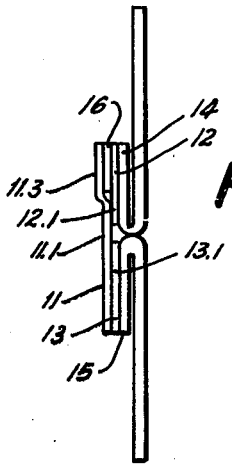
FIG. 4
FIG. 7
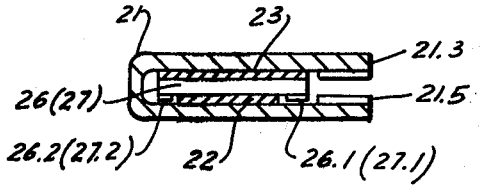

FIG. 5
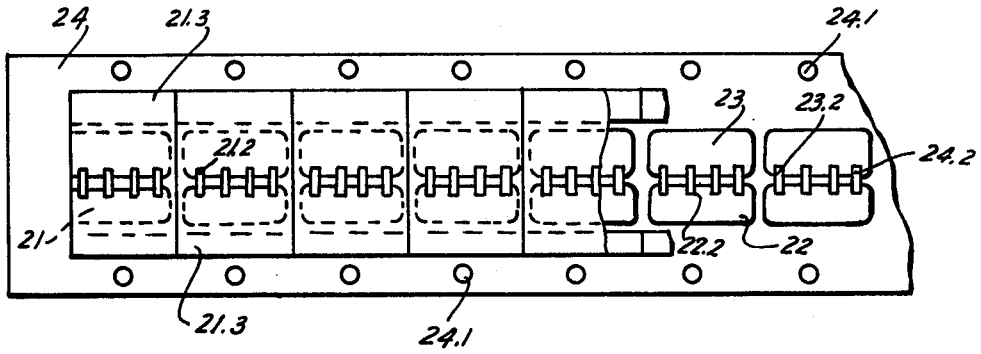
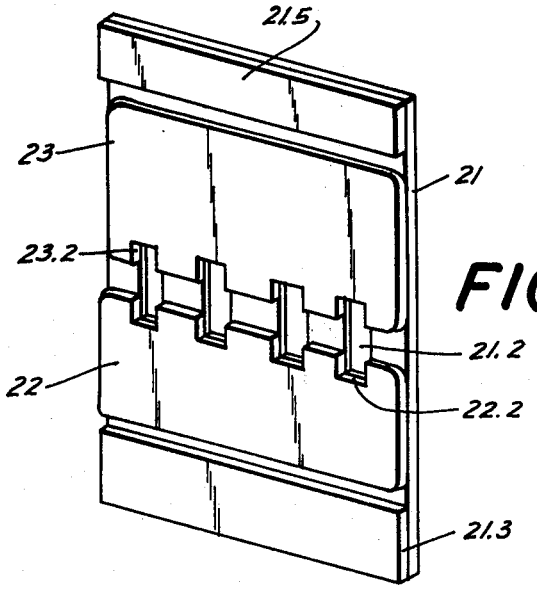
FIG. 6

FILM SPLICE

BACKGROUND OF THE INVENTION

This invention relates to an improved film splice.

More particularly, the invention relates to a film splice of the kind which is applied to opposite major surfaces of abutted film-strip ends.

Film splices for adhesively connecting the abutted ends of two film strips, so as to form a splice, have already been proposed. They utilize a single adhesive strip that is mounted on two carrier strips. In use, the carrier strips are pulled off the adhesive strip in mutually opposite directions and, while this takes place, first one portion of the adhesive strip is pressed against one major surface of the abutted film strip ends and then the remainder of the adhesive strip is similarly pressed against the other major surface of the film strip ends. The adhesive strip is provided with perforations which register with the film-strip perforations as the splice is applied.

This type of film splice, which is especially used in film presses and similar apparatus, has the disadvantage that the adhesive strip must be bent about one edge of the joined film strips, so that the total width of the film strip—from edge to edge—is increased in the splice area by at least the thickness of the adhesive strip. This has the disadvantage that when the thus joined film is run through a projector, it tends to "jump", i.e. become displaced, as the splice goes through the mechanism—and this movement is clearly visible on the projection screen. In fact, a film splice usually covers a film length corresponding to four consecutive film frames, two on each side of the butt joint. When the film is run at the internationally standard projecting speed, the "jump" or offset of the picture is visible on the screen for about one-fourth second, which is long enough to be found intensely disturbing by the human eye and mind. In the event that for some reason several of these splices follow one another in close succession as is often the case with spliced film, the disturbance which they create due to the constant "jumping" of the image on the screen, becomes just about intolerable.

SUMMARY OF THE INVENTION

It is an object of the invention to overcome the disadvantages outlined above.

More particularly, it is an object of the invention to provide an improved film splice which overcomes these disadvantages.

In keeping with these objects, and with others which will become apparent hereafter, one feature of the invention resides in a film splice for joining butted-together film ends. Briefly stated, the novel film splice comprises a film splice for joining butted-together film ends, comprising carrier foil means. A pair of discrete adhesive film-splicing tabs provided on the carrier foil means. A positioning strip engaging the tabs and operative for positioning the same in predetermined orientation relative to one another when the tabs are respectively adhesively applied to one and to another side of film strips to join together the respective butted-together ends thereof.

The film splice according to the invention permits an adhesive strip to be applied over the butt joint at each surface of the butted film strips, as before; however, unlike the prior art the novel film splice makes this possible without requiring that the adhesive strip be bent about one edge of the joined-together film strips.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 1 is a perspective exploded view of the novel film splice;

FIG. 2 is a side view of the splice;

FIG. 4 is similar to FIG. 2, but illustrates a further embodiment;

FIG. 5 is a fragmentary plan view of another embodiment;

FIG. 6 is a fragmentary perspective view of the embodiment in FIG. 5; and

FIG. 7 is a cross-sectional elevation, showing the splice of FIGS. 5 and 6 applied to a film-end butt-joint.

DESCRIPTION OF THE PREFERRED EMBODIMENTS

Figure 3:
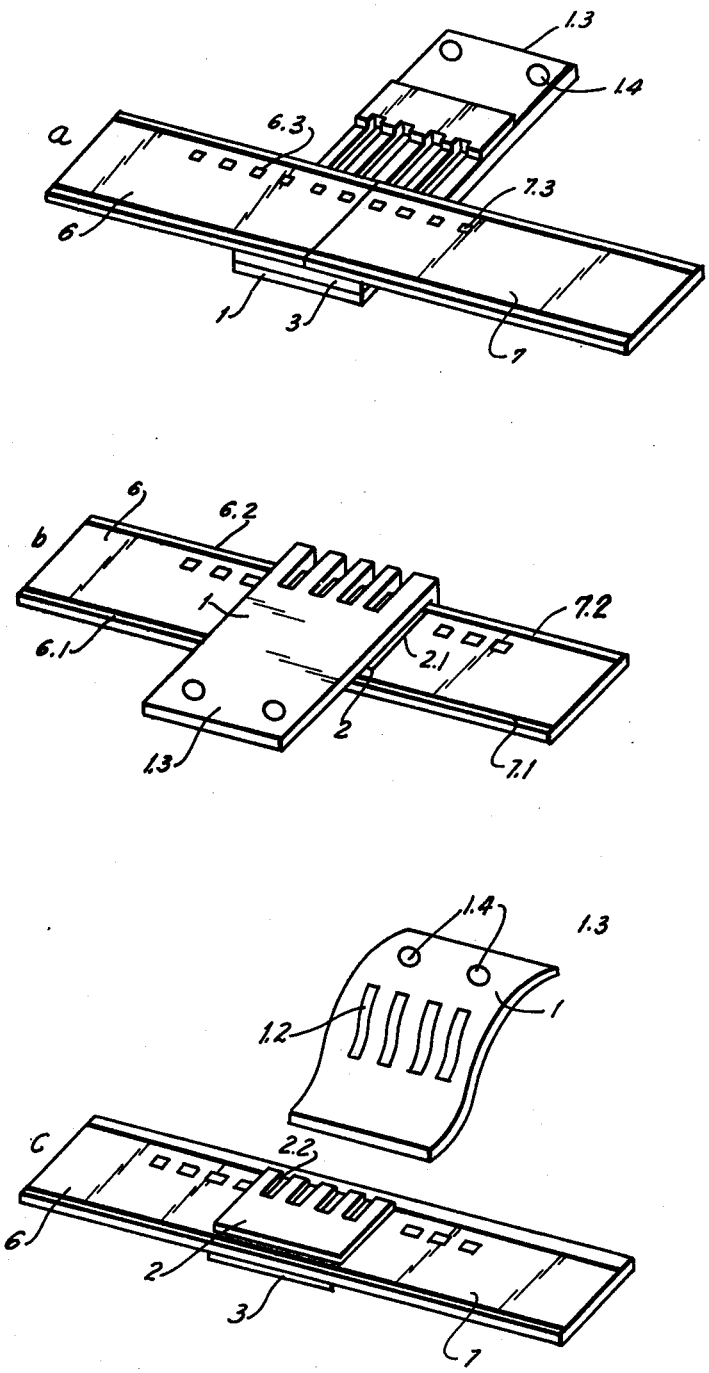
FIG. 3 *a–c* show the application of the novel splice to a film-end butt-joint.

One embodiment of the invention is illustrated in FIGS. 1 and 2, whereas FIG. 3 shows how the splice may be applied to make a butt joint.

The splice in FIGS. 1 and 2 is composed of two splice tabs 2 and 3, where adhere via adhesive layer 1.1 to a positioning strip 1. Also provided are a carrier strip 4 which adheres to tab 2 via the adhesive layer 2.1 of the same, and a carrier strip 5 which adheres to tab 3 via the adhesive layer 3.1 of the latter.

Strip 1, tabs 2, 3 and strips 4, 5 are provided with cut-outs 1.2, 2.2, 3.2, 4.2 and 5.2 respectively; these are to register with the film-advancing perforations of the film strips which are being spliced together.

Strip 1, tabs 2, 3 and strips 4, 5 are provided with cut-outs 1.2, 2.2, 3.2, 4.2 and 5.2 respectively; these are to register with the film-advancing perforations of the film strips which are being spliced together.

The purpose of positioning strip 1 in this as well as in all other embodiments, is to maintain the tabs 2, 3 in predetermined positions relative to one another, i.e. to assure a geometrically correct application of the tabs to the opposite surfaces of the film strips that are being joined. It is noted, in this connection, that the tabs 2, and 3 and their perforations 2.2 and 3.2 are of different dimensions in this embodiment because they are intended to splice together two sound-film strips. Sound-film has two transversely spaced sound tracks, a main track and an auxiliary track. To allow for this the splice 3 corresponds to the full width of the film strips since it is to be applied to the surface which does not have the sound tracks, whereas tab 2 is to be applied to the sound-track carrying film surface and has a width at most corresponding to the spacing between the sound tracks to avoid overlapping and interfering with the same.

The application of the splice of FIGS. 1 and 2 to two abutted sound-film strips 6 and 7 is shown in FIGS. 3*a*–3*c*.

As shown in FIG. 3*a*, the free ends of the sound-film strips 6, 7, which latter have main sound tracks 6.1 and 7.1 extending along their unperforated edges and auxiliary sound tracks 6.2 and 7.2 along their perforated edges are abutted with one another and adhered under pressure to the adhesive layer of the tab 3 which has been pulled off the carrier strip 5 together with the positioning strip 1. In a suitable manner—e.g. by means of guide pins or abutments if the splicing takes place in a film press or analogous device—it is assured that the perforations 6.3 and 7.3 of the film strips 6 and 7 register with the cut-outs 3.2 of tab 3 as well as with the cut-outs 1.2 of the positioning strip 1 which is at this location beneath the tab 3 and is still connected thereto via the adhesive layer 1.1.

FIG. 3*b* shows that in a subsequent step which is preferably carried out in a film press, the carrier strip 4 is pulled off the tab 2 and the positioning strip 1 is folded about the perforated edge of the film strips 6, 7. This causes the tab 2 on strip 1 to lie on the film-strip surface which carries the sound tracks. The positioning of tab 2 by strip 1 is so exact that tab 2 becomes located precisely between the tracks 6.1, 7.1 and 6.2, 7.2 and that the cut-outs 2.2 of tab 2 register with the perforations 6.3 and 7.3 of the film strips 6, 7. The tab 2 is pressed against the film strips 6, 7 to which it adheres via its adhesive layer 2.1.

The application of the splice is now complete and all that remains, as shown in FIG. 3*c* is to grip the free end portion 1.3 of the strip 1 and to pull the latter off the two tabs 2 and 3 which adhere to the film strips 6 and 7. To avoid pulling the tabs 2 and 3 off the film strips 6 and 7 during this operation, the adhesive power of the layer 1.1 on strip 1 should be smaller than the adhesive power of the layers 2.1 and 3.1 which hold tabs 2 and 3 to film strips 6 and 7.

The operations described above with reference to FIGS. 3*a*–3*c* can all be carried out manually. However, because of the greater ease involved it is preferable if they are carried out in a film press. Free end 1.3 of strip 1 is provided with one or more openings 1.4 in which a pulling-off instrumentality of such a film press may engage.

FIG. 4 shows another embodiment which is reminiscent of the one in FIGS. 1 and 2. Here, the splice has a positioning strip 11 which is provided with an adhesive layer 11.1 whereon two tabs 12 and 13 are secured in preoriented relative positions. Each tab has a carrier strip 14 or 15, respectively, secured to it via a respective adhesive layer 12.1 and 13.1.

Unlike FIGS. 1 and 2, the strip 11 of FIG. 4 does not have its free end portion extending beyond the associated tab. Instead, the free end portion 11.3 of strip 11 overlies the tab 12 but is separated therefrom by a spacer strip 15 so as to be readily engageable.

Strip 11 is pulled off—after tabs 12, 13 have been applied as described before—by hand or in a film press. The pulling-off instrumentality of such a press may engage free end portion 11.3 from both sides, or may engage in holes (not shown) that may be provided in the end portions 11.3. The spacing strip 15 is pulled off with the positioning strip 11.

FIGS. 5–7 show still another embodiment. The main difference of this embodiment over those already described is that a single carrier strip or band 24 is employed, on which pairs of tabs 22, 23 and respective associated positioning strips 21 are provided. Strip 24 is preferably a band or tape, which advantageously can be rolled up in coil form, and carries a series of the pairs of tabs and strips 21 next to each other. Strip 24 is preferably of silicon-based or siliconized material. It has rows of perforations 24.1—preferably along both edges—which serve for feeding and properly positioning it, e.g. in a film press.

As already mentioned, each pair of tabs 22, 23 has a positioning strip 21 overlying it. The adhesive layer of strip 21 adheres to the non-adhesive surfaces of tabs 22, 23. Cut-outs 24.2 and 21.2 are provided in strips 24 and 21, respectively, and cut-outs 22.2 and 23.2 are provided in tabs 22 and 23, respectively. Their purpose is proper relative alignment, as explained previously.

When splicing begins the tabs 22, 23 are received from carrier strip 24. For this purpose both free ends 21.3 of positioning strip 21 are protected against adhering to the tabs by means of a layer 21.5 of e.g. smooth-surfaced paper. A pull in one of the free ends 21.3 pulls strip 21 and tabs 22, 23 off the strip 24; tabs 22, 23 adhere to strip 21 because their adhesion to strip 24 is lower (due to the silicon-coating or silicon-treatment of strip 24) than their adhesion to strip 21.

The strip 21 is thus folded about one edge of film strips 26, 27, preferably in a film press, which places tab 22 onto the film surface having sound tracks 26.1, 26.2, 27.1, 27.2 so as to be located intermediate these tracks, whereas the wider tab 23 is placed onto the other film surface, as shown in FIG. 7. Both tabs 22, 23 are pressed against the film strips 26, 27 to become secured thereto and the positioning strip 21 is then pulled off via one of its end portions 21.3, either manually or by an instrumentality of the film press. In this embodiment, also, the adhesive force with which the strip 21 adheres to the tabs 21 must be lower than the adhesive force with which the tabs 22 and 23 adhere to the film strips, to prevent the tabs from being pulled off the film strips.

It will be understood that each of the elements described above, or two or more together, may also find a useful application in other types of applications differing from the types described above.

While the invention has been illustrated and described as embodied in a film splice, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A film splice for joining the butted ends of two film strips which have respective opposite major surfaces, comprising carrier foil means; a first and a discrete second film-splicing tab detachably mounted on said carrier foil means and each having one face directed towards and another face directed away from said carrier foil means, said tabs also each having an edge portion facing a corresponding edge portion of the respective other tab and formed with a plurality of cut-outs so as to provide the respective edge portion with a series of projections each adapted to become located on a film strip intermediate consecutive perforations of the same; and a positioning strip overlying said other faces and releasably connecting said tabs to one another so that, when said one face of said first tab is adhesively applied over one of said major surfaces and said positioning strip is thereafter folded about an edge of the film strips and said one face of the second tab is applied to the other of said major surfaces, said second tab will be located on said other major surface in a predetermined orientation relative to said first tab on said one major surface due to the presence of said positioning strip during the adhesive application of said tabs to the respective major surfaces with the projections of said tabs being located on said respective major surfaces between the consecutive film strip perforations.

2. A film splice as defined in claim 1, said positioning strip having at least one free end extending beyond said tabs and accessible for facilitating pulling-off of said positioning strip from said tabs subsequent to adhering of the same to said film strips.

3. A film splice as defined in claim 1, said positioning strip having a free end portion overlying at least one of said tabs, and comprising a layer of spacing material interposed between said free end portion and said one tab so that said free end portion can readily be lifted by a user to facilitate pulling-off of said positioning strip from said tabs.

4. A film splice as defined in claim 1, said positioning strip having a free end portion which is provided with at least one aperture for engagement with an instrumentality which serves for pulling said positioning strip off said tabs.

5. A film splice as defined in claim 1, said film tabs being of different sizes, respective one of said tabs having a width corresponding to the width of said film strips and the other tab having a lesser width.

6. A film splice as defined in claim 5, wherein said film strips have along one longitudinal edge a main audio track and along another longitudinal edge an auxiliary audio track, the width of said other tab being at most equal to the spacing between said main and auxiliary tracks.

7. A film splice as defined in claim 1, wherein said carrier foil means is a band and a plurality of pairs of said first and second tabs are provided on said band spaced lengthwise of the same, each of said pairs of tabs being provided with one of said positioning strips.

8. A film splice as defined in claim 7, wherein said band is provided with at least one row of perforations for engagement with positioning instrumentalities of a splice-forming apparatus.

9. A film splice as defined in claim 1, said positioning strip having a layer of peel-off adhesive which connects said positioning strip to said tabs while permitting it to be peeled off the same when desired.

10. A film splice as defined in claim 9, wherein each of said tabs is provided with a peel-off adhesive which releasably secures the respective tab to said carrier foil means and is adapted to adhere the tab to said film strips subsequent to release of the tab from said carrier foil means.

11. A film splice as defined in claim 10, wherein the adhesive on said tabs is of a material which adheres to said film strips with an adhesive force that is greater than the adhesive force with which said adhesive on said positioning strip adheres to said tabs.

12. A film splice as defined in claim 1, wherein the depth of said cut-outs in the edge portion of one of said tabs is greater than the depth of the cut-outs in the edge portion of the other of said tabs.

13. A film splice as defined in claim 12, wherein said one tab is wider than said other tab, as considered in direction normal to the elongation of the respective edge portions.

* * * * *